US007326524B2

(12) United States Patent
Kitahara et al.

(10) Patent No.: US 7,326,524 B2
(45) Date of Patent: Feb. 5, 2008

(54) METHODS FOR PRODUCING A NOZZLE PLATE AND NOZZLE PLATE

(75) Inventors: Seiko Kitahara, Nagoya (JP); Yasunori Kobayashi, Gifu (JP); Atsushi Ito, Owariasahi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 139 days.

(21) Appl. No.: 10/913,486

(22) Filed: Aug. 9, 2004

(65) Prior Publication Data

US 2005/0035999 A1 Feb. 17, 2005

(30) Foreign Application Priority Data

Aug. 11, 2003 (JP) ..... 2003-291417
Jul. 13, 2004 (JP) ..... 2004-205921

(51) Int. Cl.
*B14J 2/135* (2006.01)

(52) U.S. Cl. ..... 430/320; 347/45; 347/47

(58) Field of Classification Search ..... None
See application file for complete search history.

(56) References Cited

U.S. PATENT DOCUMENTS

| | | | |
|---|---|---|---|
| 5,863,371 | A | 1/1999 | Takemoto et al. |
| 6,109,728 | A | 8/2000 | Kakuda et al. |
| 6,170,934 | B1 | 1/2001 | Fujisawa et al. |
| 6,390,599 | B1 | 5/2002 | Takemoto et al. |
| 6,660,213 | B1 | 12/2003 | Sanpei et al. |

FOREIGN PATENT DOCUMENTS

| | | | |
|---|---|---|---|
| CN | 1267599 | A | 9/2000 |
| EP | 1 043 160 | A1 | 10/2000 |
| EP | 1 205 308 | A2 | 5/2002 |
| JP | A-06-246921 | | 9/1994 |
| JP | A 6-246921 | | 9/1994 |
| JP | 9-109400 | A * | 4/1997 |
| JP | A 9-131880 | | 5/1997 |
| JP | A-09-131880 | | 5/1997 |
| JP | A-09-136423 | | 5/1997 |
| JP | A-10-226070 | | 8/1998 |
| JP | A-2000-043274 | | 2/2000 |
| JP | A 2001-038913 | | 2/2001 |
| JP | A-2003-127345 | | 5/2003 |

OTHER PUBLICATIONS

Chinese Office Action for Application No. 200410057714.2 (w/English Translation).

* cited by examiner

*Primary Examiner*—John A. McPherson
(74) *Attorney, Agent, or Firm*—Oliff & Berridge, PLC

(57) ABSTRACT

A method for producing a nozzle plate includes the following steps. A photocuring resin is applied onto a surface of a substrate that includes a nozzle while an ink ejection port of the nozzle being filled with the photocuring resin. Light is irradiated to the photocuring resin from a rear surface of the substrate through the nozzle to form a columnar cured portion. The columnar cured portion includes a head portion and a base portion. The head portion protrudes from the surface of the substrate and has an outer diameter equal to or smaller than an inner diameter of the ink election port. The base portion is disposed in the nozzle and has an outer diameter equal to the inner diameter of the ink ejection port. The photocuring resin except for the columnar cured portion is removed. A water-repellent film is formed on the surface of the substrate.

11 Claims, 4 Drawing Sheets

METHODS FOR PRODUCING A NOZZLE PLATE AND NOZZLE PLATE

BACKGROUND OF THE INVENTION

1. Field of the Invention

The present invention relates to a method of producing a nozzle plate including a nozzle for ejecting ink, and also to such a nozzle plate.

2. Description of the Related Art

An ink jet head includes a nozzle plate formed with nozzles, and ejects ink from the nozzles onto a recording medium to perform a printing process. In the case where the peripheral portion of ink ejection ports of the nozzles has poor water repellency (ink repellency) and gets wetting with ink, the ink may adhere to the peripheral portion of the ink ejection ports and remain there. Furthermore, the ejected ink interfere with the ink adhering to the peripheral portion of the ink ejection ports to lower the ink impact accuracy. Therefore, a water-repellent film which can improve the water repellency is formed on the surface (the ink ejection side) of a substrate of the nozzle plate. Various methods of forming such a water-repellent film on the surface of a substrate have been proposed. Among the proposed methods, one method, after nozzles are formed in a substrate, masks ejection ports of the nozzles with a heat curable or photocuring resin, and then forms a water-repellent film on the resin (for example, see JP-A-Hei.6-246921 (pages 2-4; and FIGS. 1-4) and JP-A-Hei.9-131880 (pages 4-5; and FIGS. 2-3)).

In the water-repellent film forming method disclosed in JP-A-Hei.6-246921, first, a photocurable photosensitive resin film is pressure bonded to the front face of the substrate in which the nozzles are formed, to cause a part of the photosensitive resin film to enter the nozzles. Next, the substrate is irradiated from the rear face side with ultraviolet rays to cure the photosensitive resin film in the nozzles, whereby plug members are formed in the nozzles. With utilizing diffraction, refraction, and diffuse reflection of rays reaching the front face of the substrate through the nozzles, also the portion in the periphery of the ink ejection ports expanding radially outward from the ink ejection ports of the nozzles is cured in the photosensitive resin film on the front face of the substrate, to form an expanded portion having a diameter, which is larger than the inner diameter of the nozzles.

Furthermore, a photocurable photosensitive resin agent is applied to both the front face and rear face of the substrate, and the rear face is irradiated with light to cure the photosensitive resin agent on the rear face. The photosensitive resin film and the photosensitive resin agent, which have not been irradiated and remain on the front face of the substrate, are removed away by a solvent. At this time, the expanded portion on the substrate surface and a lining portion formed by the curing of the photosensitive resin agent on the rear face prevent the plug members from dropping off from the nozzles. In the state where the ink ejection ports of the nozzles are masked with the expanded portion and the plug member, a water-repellent film is formed on the surface of the substrate by water-repellent plating. Thereafter, the plug member, the expanded portion, and the lining portion are dissolved with solution to be removed away.

In the water-repellent film forming method disclosed JP-A-Hei.9-131880, first, a photocurable photosensitive resin film is attached to the rear face of a substrate in which nozzles are formed. The photosensitive resin film is heated and softened, so that the nozzles are filled with the photosensitive resin. The tip end face of the filling photosensitive resin is flattened, and made substantially flush with the front face of the substrate. The photosensitive resin film in the nozzles are exposed and cured, and a water-repellent film is then formed on the surface of the substrate by nickel plating. Thereafter, the photosensitive resin is removed away by a solvent.

SUMMARY OF THE INVENTION

In the water-repellent film forming method disclosed in JP-A-Hei.6-246921, in the process of curing the photosensitive resin film in the nozzles to form the plug member, the photosensitive resin film on the substrate surface is cured so that the cured portion is expanded to exceed the inner diameter of the nozzle, and the expanded portion is intentionally formed, whereby the plug member is prevented from dropping. However, the expanded portion masks not only the nozzle but also the periphery of the nozzle. When the water-repellent film is formed on the front face of the substrate, therefore, the water-repellent film is not formed in the periphery of the nozzles. As a result, ink is apt to remain the periphery of the nozzles. Hence, there arises the possibility that the water repellency is impaired and the ink impact accuracy is lowered. In order to prevent the plug member from dropping off from the nozzle, moreover, the lining portion must be formed on the rear face of the substrate. Therefore, the number of production steps is increased, and the production efficiency is lowered.

In the water-repellent film forming method disclosed in JP-A-Hei.9-131880, the tip end face of the photosensitive resin filling the nozzles is flattened, and made substantially flush with the front face of the substrate. Thereafter, the photosensitive resin in the nozzles is exposed to light to be cured. Following nickel-plating does not grow the plating film, which functions as a water-repellent film, on the photosensitive resin. However, a so-called overhang in which the nozzle is partly covered by the water-repellent film is inevitably formed. Consequently, the inner diameter of an opening of the water-repellent film is smaller than that of the nozzle, or variably formed. The ink ejected from the nozzles interferes with the overhang portion of the water-repellent film. As a result, the impact accuracy of the ink ejected from the nozzle is lowered.

The invention provides a method for producing a nozzle plate in which a region where a water-repellent film is not formed is not formed in the neighbor of a ink ejection port of a nozzle and furthermore a projection amount due to an overhanging of the water-repellent film can be reduced.

The invention also provides a nozzle plate in which a region where a water-repellent film is not formed is not formed in the neighbor of a ink ejection port of a nozzle and furthermore a projection amount due to an overhanging of the water-repellent film is small.

According to one embodiment of the invention, a method for producing a nozzle plate includes the following steps. A photocuring resin is applied onto a surface of a substrate that includes a nozzle while an ink ejection port of the nozzle being filled with the photocuring resin. Light is irradiated to the photocuring resin from a rear surface of the substrate through the nozzle to form a columnar cured portion. The columnar cured portion includes a head portion and a base portion. The head portion protrudes from the surface of the substrate and has an outer diameter equal to or smaller than an inner diameter of the ink ejection port. The base portion is disposed in the nozzle and has an outer diameter equal to the inner diameter of the ink ejection port. The photocuring resin except for the columnar cured portion is removed. A water-repellent film is formed on the surface of the substrate in a state where the columnar cured portion remains.

A part of the columnar cured portion protrudes from the surface of the substrate and has the outer diameter equal to or smaller than the inner diameter of the ink ejection port. Thus, a region where the water-repellent film is not formed is not formed in the neighbor of the ink ejection port of a nozzle. Furthermore, a projection amount due to an overhanging of the water-repellent film can be reduced. Accordingly, the water-repellency in the neighbor of the ink ejection port of the nozzle is improved, so that leakage of the ink can be prevented. In addition, the ink ejected from the nozzle does not interfere with the water-repellent film, so that the ink impact accuracy is improved.

According to one embodiment of the invention, a nozzle plate includes a nozzle from which ink are ejected, and a water-repellent film on a surface of the nozzle plate. The water-repellent film includes an opening portion, an area of which is equal to an opening area of the nozzle, at a position of the nozzle. The opening portion of the water-repellent film has an edge along the nozzle. As described above, the nozzle plate is configured so that the opening area of the opening portion formed in the water-repellent film is equal to the opening area of the nozzle, and the opening portion of the water-repellent film has the edge along the nozzle. Therefore, an ink ejected from the nozzle does not interfere with the water-repellent film. Also, the water-repellent film is formed along the ink ejection port of the nozzle, so that the ink impact accuracy is improved.

BRIEF DESCRIPTION OF THE DRAWINGS

FIG. 1A is a diagram showing a step of applying a photocuring resin; FIG. 1B is a diagram showing a curing step; FIG. 1C is a diagram showing a step of removing a uncured portion; FIG. 1D is a diagram showing a step of forming a water-repellent film; and FIG. 1E is a diagram showing a step of removing a columnar cured portion.

FIG. 2A is a diagram showing a step of applying a solution, and FIG. 2B is a diagram showing a step of removing a columnar cured portion.

FIG. 5A is a diagram showing a step of applying a photocuring resin; FIG. 5B is a diagram showing a polishing step; FIG. 5C is a diagram showing a curing step; FIG. 5D is a diagram showing a step of removing a uncured portion; FIG. 5E is a diagram showing a step of forming a water-repellent film; and FIG. 5F is a diagram showing a step of removing a columnar cured portion.

DETAILED DESCRIPTION OF THE PREFERRED EMBODIMENT

First Embodiment

A first embodiment of the invention will be described. In the first embodiment, the invention is applied to a nozzle plate, which is to be disposed in an ink jet head and includes a nozzle for ejecting ink. Hereinafter, the first embodiment will be described with reference to FIG. 1.

Figure 1A:
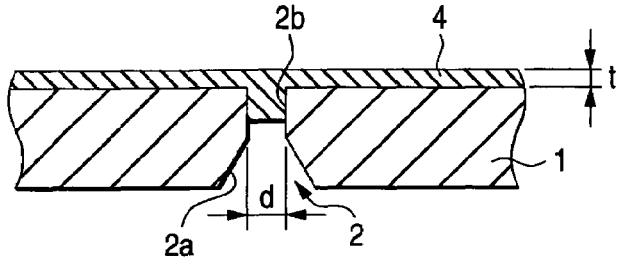
FIGS. 1A to 1E are diagrams illustrating steps of forming a water-repellent film in a first embodiment of the invention.

First, a nozzle plate P1 will be briefly described. As shown in FIG. 1E, the nozzle plate P1 includes: a nozzle 2 which is formed in a substrate 1, and from which ink is to be ejected; and a water-repellent film 3 which is formed on the surface (the face on the ink ejection side) of the substrate 1. The substrate 1 is formed of a sheet of a metal (for example, stainless steel), and has a thickness of, for example, about 70 μm. The nozzle 2 has: a taper portion 2*a* which is formed on the side of the rear face of the substrate 1 and is more tapered as further advancing toward the surface; and a straight portion 2*b* which elongates from the taper portion 2*a* to the surface of the substrate 1 so as to pass through the substrate. The taper portion 2*a* and the straight portion 2*b* are formed in the substrate 1 by an adequate method such as a press work. An ejection port 2*c* from which an ink is to be ejected is formed in the tip end of the straight portion 2*b*. The water-repellent film 3 improves the water repellency of the periphery of the nozzle ejection port 2*c* of the nozzle 2 to prevent ink wetting from occurring.

Next, a method for producing the nozzle plate P1 will be described. As shown in FIG. 1A, first, a film-like photocuring resin 4 which serves as a resist is heated and pressure bonded to the surface of the substrate 1 by using a roller or the like. With adjusting the heating temperature, the pressure, the roller speed, and the like, a tip end portion of the nozzle 2 (the straight portion 2*b*) is filled with a predetermined amount of the film-like photocuring resin 4 (a step of applying a photocuring resin). If the heating temperature during the pressure bonding of the film is excessively high, or, for example, sufficiently higher than the glass transition point, the photocuring resin 4 becomes to have fluidity. As a result, the surface of the substrate 1 cannot be coated with the photocuring resin 4 at a required film thickness (for example, about 5 to 15 μm). By contrast, if the heating temperature is excessively low, the film is not softened, and the tip end portion of the nozzle 2 cannot be filled with the required amount of the photocuring resin 4. Therefore, the heating temperature is preferably set to, for example, a temperature at which the glass transition state is attained so that the photocuring resin 4 has properties like a soft rubber. More preferably, the temperature is set to a range from 80° C. to 100° C. However, the temperature is not restricted to the range.

In order to enable the tip end portion of the nozzle 2 to be easily filled with the photocuring resin 4 of an amount which is required for forming a columnar cured portion 5, preferably, the thickness t of the film-like photocuring resin 4 is equal to or smaller than the inner diameter d of the straight portion 2*b* of the nozzle 2.

Figure 1B:
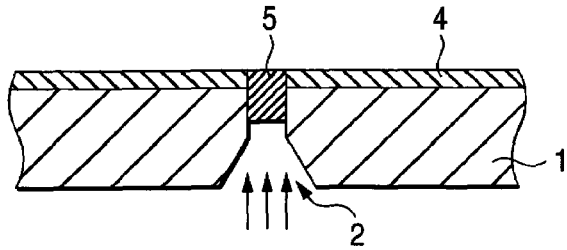

Next, as shown in FIG. 1B, the photocuring resin 4 on the surface of the substrate 1 is irradiated with ultraviolet laser light or the like from the side of the rear face through the nozzle 2, thereby curing the photocuring resin 4 (a curing step). At this time, the exposure amount of the light is adjusted so that the photocuring resin 4 in the vicinity of the ejection port 2*c* of the nozzle 2 is prevented from curing with outward extending in a radial direction of the nozzle 2.

Specifically, light passing through the nozzle 2 cures the photocuring resin 4 only in the direction along which the nozzle 2 elongates. Thereby, formed is the columnar cured portion 5 that partly protrudes from the surface of the substrate 1 and has a diameter which is equal to the inner diameter of the ejection port 2*c* of the nozzle 2.

The exposure amount is reduced as compared with a case where the photocuring resin 4 is cured so as to be completely hardened. Whereby the columnar cured portion 5 is set to a semi-cured state which is an intermediate state of the photocuring reaction. In the semi-cured state, the columnar cured portion 5 has plasticity and viscosity of a small degree, so that the side face of the portion of the columnar cured portion 5 in the nozzle 2 closely adheres to the inner face of the nozzle 2. In order to form such a columnar cured portion 5, it is preferable that, when the exposure amount required for curing the photocuring resin 4 is indicated by 100, the exposure amount of light with which the photocuring resin 4 is irradiated is set to in a range of 20 to 50. The exposure amount is expressed by the product of the intensity of the irradiating light by the irradiating time. When one or both of the light intensity and the irradiating time are adjusted, the exposure amount can be arbitrarily set within the above-mentioned range.

Figure 1C:
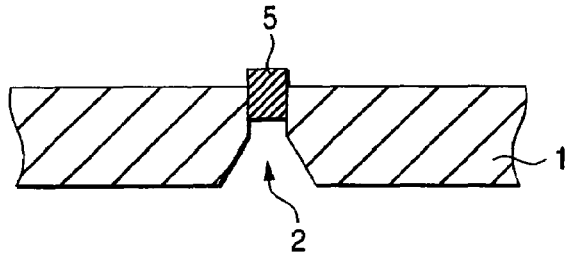
Figure 1D:
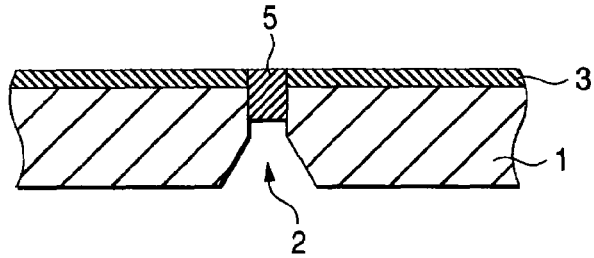
Figure 1E:
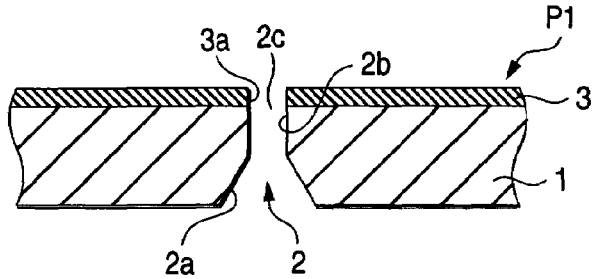

Next, as shown in FIG. 1C, a portion of the photocuring resin 4 on the surface of the substrate 1 other than the columnar cured portion 5 is dissolved with a developing solution such as 1% $Na_2CO_3$ (alkali removing liquid) to be removed away. The columnar cured portion 5 remains so as to mask the nozzle ejection port 2*c* of the nozzle 2 and protrude from the surface of the substrate 1 (a step of removing a uncured portion). In this state, as shown in FIG. 1D, water-repellent plating such as nickel plating containing fluorine polymer material such as polytetrafluoroethylene (PTFE) is applied to the surface of the substrate 1 to form the water-repellent film 3 having 1 to 5 μm in thickness (a step of forming a water-repellent film). Then, as shown in FIG. 1E, the columnar cured portion 5 is dissolved with a removing solution such as 3% NaOH to be removed away (a step of removing a columnar cured portion).

The columnar cured portion 5 is formed so as to partly protrude from the surface of the substrate 1 and have a diameter which is equal to the inner diameter d of the nozzle 2 (the straight portion 2*b*). When the water-repellent film 3 is formed on the surface of the substrate 1 and then the columnar cured portion 5 masking the nozzle 2 is then removed away, therefore, an opening 3*a* having an opening area which is equal to that of the nozzle 2 is formed at the position of the nozzle 2 in the water-repellent film 3. Furthermore, the water-repellent film 3 does not exist above the nozzle 2, or an overhang is not formed. In other words, in the nozzle plate P1, the water-repellent film 3 is formed so as to extend along the ejection port 2*c* of the nozzle 2. Therefore, the water repellency of the periphery of the ejection port 2*c* is improved. Hence, it is possible to surely prevent the periphery of the nozzle 2 from getting wetting with ink. Moreover, the inner diameter (opening area) of the opening 3*a* formed in the water-repellent film 3 does not fluctuate. When an ink is ejected from the nozzle 2, the ink does not interfere with the water-repellent film 3. Consequently, the ink impact accuracy is improved.

The method of producing the nozzle plate P1, and the nozzle plate P1 which have been described above can attain the following effects. The photocuring resin 4 on the surface of the substrate 1 is irradiated with light through the nozzle 2 from the side of the rear face of the substrate 1, whereby the columnar cured portion 5 that partly protrudes from the surface of the substrate 1 and has a diameter which is equal to the inner diameter of the ejection port 2*c* of the nozzle 2 can be formed, so that the ejection port 2*c* of the nozzle 2 can be masked. Therefore, when the columnar cured portion 5 is formed and then the water-repellent film 3 is formed on the surface of the substrate 1, the water-repellent film 3 is formed so as to extend along the ejection port 2*c* of the nozzle 2. The water-repellent film 3 does not exist above the nozzle 2, so that an overhang is not formed. Consequently, the water repellency of the periphery of the ejection port 2*c* of the nozzle 2 is improved. Hence, it is possible to prevent the periphery of the ejection port 2*c* from getting wetting with ink. Moreover, the inner diameter (opening area) of the opening 3*a* formed in the water-repellent film 3 does not fluctuate. When an ink is ejected from the nozzle 2, the ink does not interfere with the water-repellent film 3. As a result, the ink impact accuracy is improved.

When the exposure amount of the irradiating light is adjusted, the columnar cured portion 5 is set to the semi-cured state which is an intermediate state of the photocuring reaction of the photocuring resin 4. Therefore, the columnar cured portion 5 enters the state where it has plasticity and viscosity of a small degree, so that the side face of the columnar cured portion 5 closely adheres to the inner face of the nozzle 2 (the straight portion 2*b*). As a result, when the uncured portion other than the columnar cured portion 5 is removed away, the columnar cured portion 5 does not drop off from the nozzle 2.

Next, modifications in which the first embodiment is variously modified will be described. The portions which are similarly configured as those of the first embodiment are denoted by the same reference numerals, and their description is adequately omitted.

1] In the first embodiment, the film-like photocuring resin is pressure bonded to the surface of the substrate 1 to fill the nozzle 2 with the photocuring resin 4. Alternatively, a liquid photocuring resin may be applied onto the surface of the substrate 1 to fill the nozzle 2 with the photocuring resin 4.

Figure 2A:
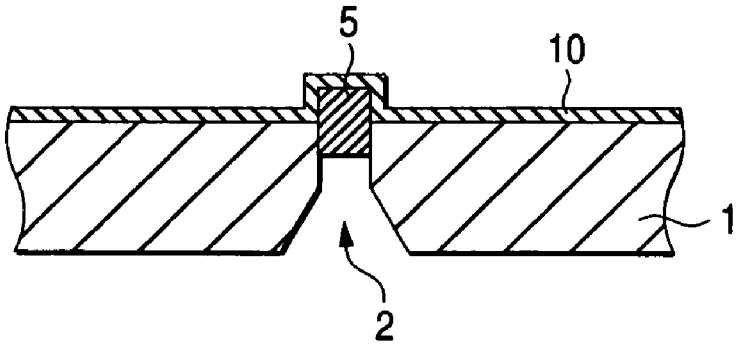
FIGS. 2A and 2B are diagrams illustrating steps of forming a water-repellent film in a modification.
Figure 2B:
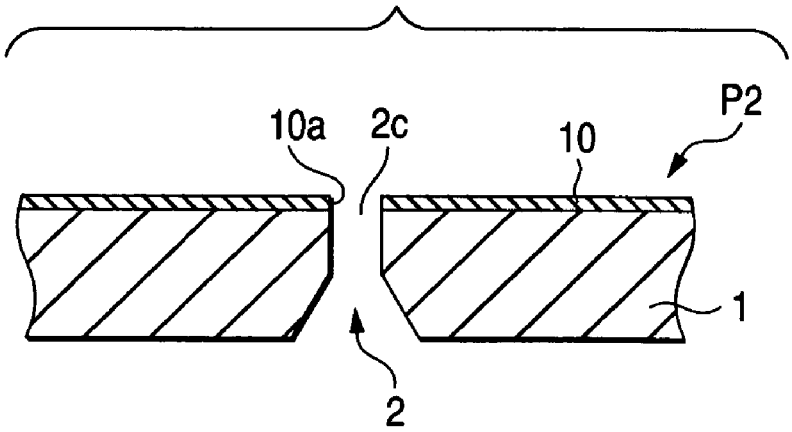

2] In place of the water-repellent plating in the first embodiment, a solution of a fluororesin such as a fluorine-containing copolymer having a cyclic structure (Cytop: ASAHI GLASS CO., LTD.), or a silicon resin may be applied to form the water-repellent film on the substrate surface. As shown in FIG. 2A, in production of a nozzle plate P2, for example, a solution of Cytop or the like is applied at a predetermined film thickness (for example, about 0.1 μm) by a known method such as the spin coat method to form a water-repellent film 10 on the surface of the substrate 1. Then, as shown in FIG. 2B, the columnar cured portion 5 is removed away by a solvent. Thereby, an opening 10*a* having an opening area, which is equal to that of the nozzle 2, is formed in the water-repellent film 10. As a result, a state where the water-repellent film 10 is formed along the ejection port 2*c* of the nozzle 2 is obtained.

EXAMPLE 1

The above-described methods of producing a nozzle plate were checked by the following method. A nozzle including a ejection port having an inner diameter of 20 μm was formed in a substrate made of SUS430 having a thickness of 75 μm. Then, a photocuring resin film was pressure bonded to the surface of the substrate at a pressure of 0.2 MPa (about 2 kg/cm$^2$) under the state where the film was heated to 70° C. In the pressure bonding of the photocuring resin film, a roller is moved at movement velocity 1 m/min twice to apply the pressure of 0.2 MPa to the surface of the substrate. As the photocuring resin film, Ohdil (dry film photoresist) FP215 (glass transition point Tg: an initiating temperature of 65° C. and an ending temperature of 95° C.) produced by TOKYO OHKA KOGYO CO., LTD. was used. The thickness thereof was 15 μm. The photocuring resin film was substantially hardened by an exposure amount of 100 mJ/cm$^2$. Under this state, light irradiation was conducted while changing the exposure amount. The outer diameter of a portion of a columnar cured portion, which was formed as a result of the irradiation and protruded from the ejection port of the nozzle, was measured with using a surface profile measuring device such as a surface step-difference meter. The results are listed in Table 1.

TABLE 1

| Exposure amount (mJ/cm$^2$) | Outer diameter of cured portion (μm) | Ratio to diameter of nozzle |
|---|---|---|
| 300 | 24.6 | 1.23 |
| 150 | 23.1 | 1.155 |
| 100 | 22.4 | 1.12 |
| 75 | 21.9 | 1.095 |
| 50 | 19.5 | 0.975 |
| 30 | 19.5 | 0.975 |
| 20 | 19.5 | 0.975 |

As shown in Table 1, it can be seen that as the exposure amount is larger, the outer diameter of the portion of the columnar cured portion, which protrudes from the ejection port of the nozzle, is larger and the photocuring resin is cured with further extending radially outward from the ejection port of the nozzle. By contrast, it can be seen that, in the cases where the exposure amount is set to 50, 30, and 20 mJ/cm$^2$ (namely, the exposure amount of light with which the photocuring resin is irradiated is in the range of 20 to 50 when the exposure amount (100 mJ/cm$^2$) required for curing the photocuring resin is indicated by 100), the columnar cured portion, which has the portion protruding from the ejection port of the nozzle having the outer diameter slightly smaller than the inner diameter (20 μm) of the ejection port of the nozzle. At this time, strictly speaking, the columnar cured portion has a truncated cone shape. The outer diameter of the portion, which is located in the nozzle, (the portion not-protruding from the ejection port of the nozzle) is equal to the inner diameter of the ejection port of the nozzle. In this way, when the diameter of the portion of the columnar cured portion protruding from the ejection port of the nozzle is formed to be slightly smaller than the inner diameter of the ejection port of the nozzle, the water-repellent film can be formed along the ejection port, which is masked with the columnar cured portion. Also, when the outer diameter of the portion of the columnar cured portion, which is located in the nozzle, is made to be equal to the inner diameter of the ejection port of the nozzle, the outer peripheral surface of the columnar cured portion can be brought in closely contact with the inner surface of the nozzle.

Incidentally, in these cases, the exposure amount of light irradiated to the photocuring resin was smaller than that required to a case where the photocuring resin was completely hardened. Therefore, the columnar cured portion contains a remaining photocuring resin due to insufficient curing reaction by the light and is in a semi-cured state where the columnar cured portion has plasticity and viscosity. The plasticity and viscosity of the photocuring resin also have an influence on a removability of the photocuring resin.

Figure 3:
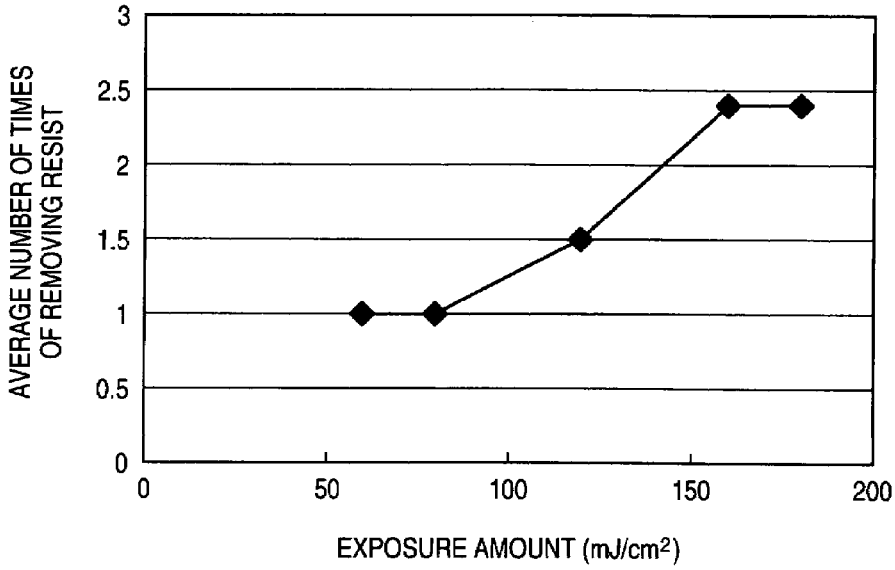
FIG. 3 is a graph showing a relation between the exposure amount of light irradiated to the photocuring resin and the removability of the columnar cured portion under the above described condition.

The above-described methods of producing a nozzle plate will be checked with reference to FIG. 3. FIG. 3 is a graph showing a relation between the exposure amount of light irradiated to the photocuring resin and the removability of the columnar cured portion under the above described condition. Incidentally, in order to reduce diffuse reflection of the irradiated light, a polishing process was applied to a surface opposite to an ink ejection surface of the substrate. Therefore, in comparison with a case of using a substrate to which the polishing process was not applied, an exposure amount of light required to form the columnar cured portion is larger. In addition, since light irradiated to the tapered surface of the substrate is reflected and irradiated to the photocuring resin, an exposure amount of light, which is actually irradiated to the photocuring resin, is 120% of an exposure amount measured at an exposure device side. Specifically, when the measured exposure amount is 80 mJ/cm$^2$, the exposure amount of the light actually irradiated is about 100 mJ/cm$^2$.

Generally, compositions of the photocuring resin (dry resist film) includes binder polymer, photoinitiator, polyfunctional monomer, and other additives. The alkali development-type resist such as Ohdil FP215 produced by TOKYO OHKA KOGYO CO., LTD., which is a photocuring resin and is used in the first embodiment, has a property that the binder polymer is dissolved in the alkali removing liquid. When curing of the photocuring resin proceeds, the polyfunctional monomer and the binder polymer form cross-link and molecules have a net-like three-dimensional structure, so that the cured resin is not dissolved in alkali solvent. When the photocuring resin is cured with a small exposure amount, this cross-link reaction does not proceed sufficiently. Therefore, the removing process of washing the substrate with the alkali removing liquid easily divides and/or solve the columnar cured portion (resist). As shown in FIG. 3, when light having an exposure amount exceeding 80 mJ/cm$^2$ (light actually irradiated had an exposure amount of 100 mJ/cm$^2$ or more) was irradiated to the photocuring resin, the curing of the columnar cured portion more proceeded. Therefore, the columnar cured portion was not removed unless the removing process was executed several times. On the other hand, when light having an exposure amount of 80 mJ/cm$^2$ or less was irradiated to the photocuring resin, the columnar cured portion was in the semi-cured state. Therefore, a single removing process could remove the columnar cured portion.

Next, checked will be a relation between the exposure amount of light irradiated to the photocuring resin and a cure ratio (progress degree of the cure) of the photocuring resin, which is indicator of the semi-cured state. When the photocuring resin is cured, the photocuring resin generates reaction heat. Therefore, it is possible to measure the cure ratio by measuring a heat amount of the reaction heat generated at the time when the photocuring resin is cured. At this time, we can obtain the cure ration by comparing a heat amount generated by the photocuring resin in which the curing reaction has not been initiated, and a heat amount of the photocuring resin in which the curing reaction has proceeded. A general differential scanning calorimetry (DSC) apparatus is used as a measurement device. In this mesurement, DSC6220 produced by SII NanoTechnology Inc. was used. An actual measurement procedure using this apparatus was performed in conformity with JIS K7122 ("Testing methods for heat of transitions of plastics"). This standard is a measurement method used for measuring the transition temperatures of plastics. However, in accordance with this standard, a heat amount, which the plastic itself (resin) absorbs as the transition reaction of the plastic proceeds, can be measured.

In a case of measuring the transition temperature of plastic, we wait until the measurement apparatus stabilizes at a temperature, which is lower than the transition temperature by 100° C.; the plastic is heated at heating acceleration of 10° C./minute; and DSC curve is obtained until the temperature is higher than the transition temperature of the plastic by about 30° C. On the contrary, the reaction of curing the photocuring resin (resin) is an exothermic reaction, and sign of the measured heat amount is different from the time when the transition temperature of plastic is measured. However, they are similar in that a heat amount required for a reaction is measured. In other words, as with the measurement method prescribed in JIS K7122, in the measurement of the cure ratio of the photocuring resin, the inventors waited until the measurement apparatus stabilized at a temperature, which was lower than the curing reaction initial temperature (about 130° C.) by 100° C.; the photocuring resin was heated at heating acceleration of 10° C./minute; and DSC curve was obtained until the temperature became higher than the curing termination temperature (about 170° C.) by about 30° C.

In this measurement, a measurement range was set to be in a range of 25° C. to 200° C., and the DSC curve in that range was read and obtained. Then, a peak area (an area surrounded by the peak and the base line) of the obtained DSC curve was calculated. This calculation of the peak area conformed to the method prescribed in JIS K7122. Furthermore, the calculated peak area was divided by a weight of a measurement sample to obtain a curing reaction heat amount per unit weight. Accordingly, the cure ratio of resin was defined as follows. The curing reaction heat amount of the photocuring resin to which light had not been irradiated was obtained and was set as the cure ratio 0%. On the contrary, the photocuring resin, which did not show the curing reaction heat amount at all because the curing reaction had proceeded sufficiently, was set as the curing ratio 100%. With regard to the semi-cured photocuring resin in which polymerization (curing reaction) had proceeded to some extent due to the exposure, the curing reaction heat of a part of the photocuring resin, which had not been exposed, in the photocuring resin, was obtained. Therefore, the curing reaction heat of the semi-cured photocuring resin was divided by that of the uncured photocuring resin, and then this obtained value was subtracted from 100%. to determine the cure ratio of the semi-cured photocuring resin.

Figure 4:
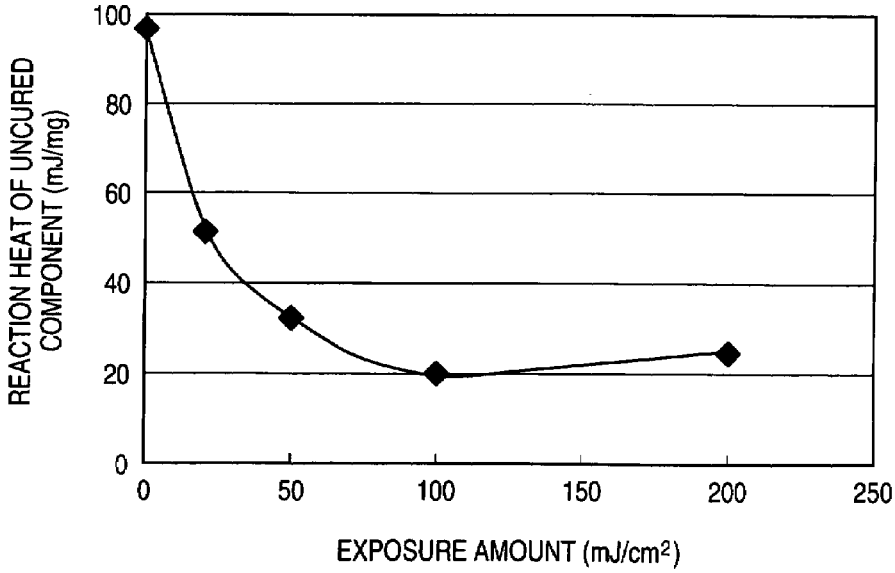
FIG. 4 is a graph showing a relation between an exposure amount of light irradiated to the photocuring resin per unit area and the curing reaction heat of the uncured photocuring resin per unit weight

A measurement result is shown in FIG. 4. FIG. 4 is a graph showing a relation between an exposure amount of light irradiated to the photocuring resin per unit area and the curing reaction heat of the uncured photocuring resin per unit weight. As shown in FIG. 4, the curing reaction heat of the uncured photocuring resin was 100 mJ/mg. When the exposure amount of light irradiated to the photocuring resin per unit area was 100 mJ/cm$^2$, the reaction heat of the photocuring resin was 20 mJ/mg. A ratio of the photocuring resin, which had not been exposed, was 20×100/100=20%. Therefore, in this case, the cure ratio of the photocuring resin was 80%. Incidentally, when the exposure amount was equal to or larger than 100 mJ/cm$^2$, the reaction heat was substantially saturated at 20 mJ/mg. The reason is described below. The curing reaction of the photocuring resin includes a reaction to which light contributes and a reaction to which heat contributes. When the exposure amount is equal to or larger than 100 mJ/cm$^2$, the reaction to which the light contributes has almost been completed. Therefore, in any sample, the reaction to which the heat contributes are observed.

From FIG. 3, under the aforementioned conditions of the substrate and the photocuring resin, it is preferable to irradiate light having an exposure amount of 80 mJ/cm$^2$ or less to the photocuring resin in order to form the columnar cured portion in view of the removability of the columnar cured portion. In other words, it is preferable that light, which is actually irradiated to the photocuring resin, has an exposure amount of 100 mJ/cm$^2$. Under this exposure condition, from FIG. 4, the cure ratio of the columnar cured portion is 80% or less. Also, it is necessary for the columnar cured portion formed thus to maintain its shape so long as the columnar cured portion functions as a resist. Specifically, the cure ratio of the columnar cured portion should be 50% or more. In the case where the cure ratio is lowered, even if light has been irradiated to the photocuring resin, a lot of unexposed components of the photocuring resin remains in the exposed region. Therefore, in the removing of the photocuring resin except for the columnar cured portion (step of removing a uncured portion), a liquid developer used removes the unexposed components of the photocuring resin from the surface of the columnar cured portion. As a result, after the development, the columnar cured portion loses a desired shape. Accordingly, it is preferable to determine the exposure amount of light irradiated to the photocuring resin in accordance with a shape of the substrate and conditions of the photocuring resin so that the cure ratio of the columnar cured portion is in a range of 50% to 80%.

Second Embodiment

Next, a second embodiment of the invention will be described. The portions which are similarly configured as those of the first embodiment are denoted by the same reference numerals, and their description is adequately omitted. Hereinafter, description will be made with reference to FIG. 5.

Figure 5A:
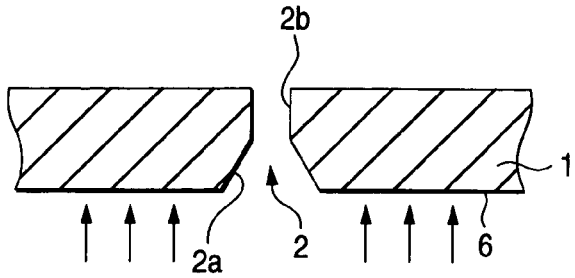
FIGS. 5A to 5F are diagrams illustrating steps of forming a water-repellent film in a second embodiment of the invention.
Figure 5B:
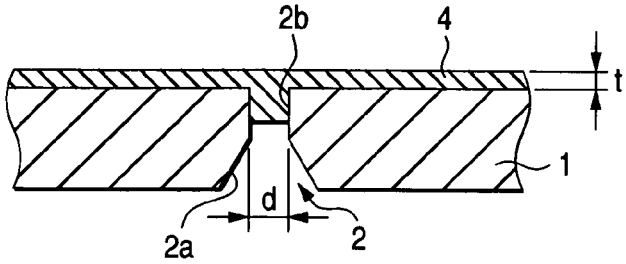
Figure 5C:
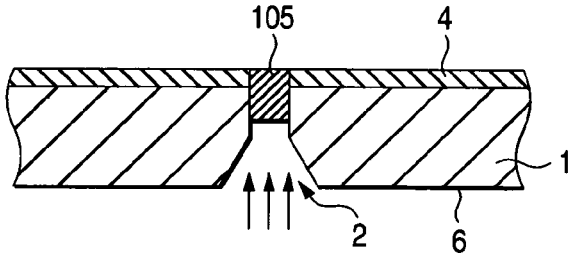

First, a nozzle plate P3 will be briefly described. As shown in FIG. 5F, the nozzle plate P3 includes: a nozzle 2 which is formed in a substrate 1, and from which ink is to be ejected; and a water-repellent film 3 which is formed on the surface (the face on the ink ejection side) of the substrate 1. On a rear side of the substrate 1, a flat polished surface 6 is formed.

Next, a method for producing the nozzle plate P3 will be described. First, as shown in FIG. 5A, a surface polishing process is applied to all over the rear surface side of the substrate 1 to form the polished surface 6 (see an arrow in FIG. 5A: a polishing step). When the taper portion 2*a* of the nozzle 2 is formed by a process such as the press working, a fine protruding portion is formed on an edge portion of the taper portion 2*a* on the rear face side of the substrate 1. The surface polishing process applied to the rear face side removes the fine protrusion portion. Next, as shown in FIG. 5B, a step of applying a photocuring resin is performed. The step of applying the photocuring resin is substantially similar to that of the first embodiment. Thus, detailed explanation thereon will be omitted. Next, Next, as shown in FIG. 5C, the photocuring resin 4 on the surface of the substrate 1 is irradiated with ultraviolet laser light or the like from the polished surface 6 side of the substrate through the nozzle 2, thereby curing the photocuring resin 4 (a curing step). In other words, the substrate 1 functions as a make for masking the photocuring resin 4. Here, an exposure amount of light is adjusted so that the photocuring resin 4 in the vicinity of the ejection port 2*c* of the nozzle 2 is prevented from curing with outward extending in a radial direction of the nozzle 2. The exposure amount of light is adjusted in accordance with a diameter of the ejection port 2*c* of the nozzle 2, an angle of inclination of the taper portion 2*a*, a length of the straight portion 2*b* and/or the like.

For example, when the opening diameter of the nozzle 2 is 20μm; the taper angle of the taper portion 2*a* is 8 degrees; and the straight length of the straight portion 2*b* is 0, it is preferable that the exposure amount of light is 180 mJ/cm$^2$. Also, when the opening diameter of the nozzle 2 is 22 μm; the taper angle of the taper portion 2*a* is 8 degrees; and the straight length of the straight portion 2*b* is 0, it is preferable that the exposure amount of light is 210 mJ/cm$^2$. Also, when the opening diameter of the nozzle 2 is 25 μm; the taper angle of the taper portion 2*a* is 20 degrees; and the straight length of the straight portion 2*b* is 0, it is preferable that the exposure amount of light is 180 mJ/cm$^2$. Furthermore, if the straight length of the straight portion 2*b* is lengthen in the above conditions, it is preferable to increase the exposure amount of light.

Light passing through the nozzle 2 cures the photocuring resin 4 only in the direction along which the nozzle 2 elongates. In other words, formed is a columnar cured portion 105 which includes a base portion and a head portion. The base portion has an outer diameter, which is equal to an inner diameter of the ejection portion 2*c* of the nozzle 2. The head portion protrudes from the surface of the substrate 1 by 1 to 15 μm and has an outer diameter, which is smaller than that of the base portion by about 0.1 μm. The columnar cured portion 105 is a suitable columnar cured portion which can form a water-repellent film without forming an overhang portion.

Figure 5D:
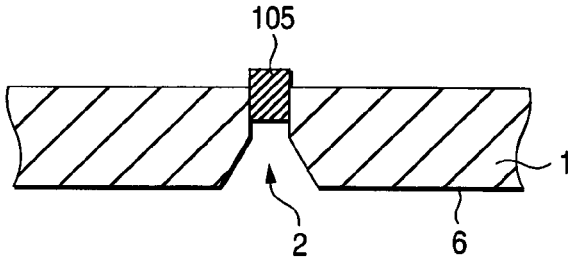
Figure 5E:
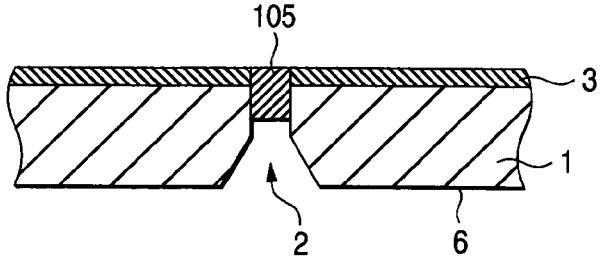
Figure 5F:
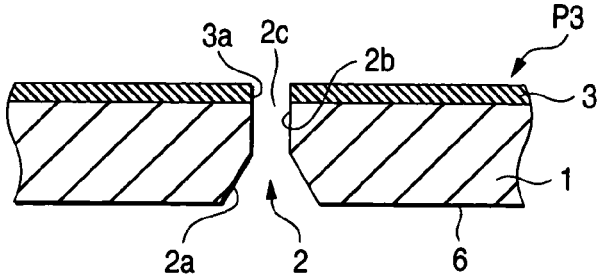

Next, as shown in FIG. 5D, a step of removing a uncured portion is performed. The step of removing the uncured portion is substantially similar to that of the first embodiment. Thus, an explanation thereon will be omitted. Furthermore, as shown in FIG. 5E, a step of forming a water-repellent film is performed. The step of forming the water-repellent film is substantially similar to that of the first embodiment. Thus, an explanation thereon will be omitted. Then, as shown in FIG. 5F, a step of removing a columnar cured portion is performed. The step of removing the columnar cured portion is substantially similar to that of the first embodiment. Thus, an explanation thereon will be omitted.

The method of producing the nozzle plate P3, and the nozzle plate P3 which have been described above can attain the following effects. The photocuring resin 4 on the surface of the substrate 1 is irradiated with light through the nozzle 2 from the side of the rear face of the substrate 1, whereby the columnar cured portion 105 that partly protrudes from the surface of the substrate 1 and has a diameter which is equal to the inner diameter of the ejection port 2*c* of the nozzle 2 can be formed. The ejection port 2*c* of the nozzle 2 can be masked with this columnar cured portion 105. Therefore, when the water-repellent film 3 is formed on the surface of the substrate 1, the water-repellent film 3 is formed so as to extend along the ejection port 2*c* of the nozzle 2. Furthermore, the water-repellent film 3 does not exist above the nozzle 2, so that an overhang is not formed. Consequently, the water repellency of the periphery of the ejection port 2*c* of the nozzle 2 is improved. Hence, it is possible to prevent the periphery of the ejection port 2*c* from getting wetting with ink. Moreover, the inner diameter (opening area) of the opening 3*a* formed in the water-repellent film 3 does not fluctuate. When an ink is ejected from the nozzle 2, the ink does not interfere with the water-repellent film 3. As a result, the ink impact accuracy is improved.

Also, in the polishing step, the protrusion portion formed in the periphery of the opening portion of the rear surface of the substrate 1 is removed. Thereafter, in the curing step, light is irradiated. Therefore, it can be prevented that the light is irradiated to the protrusion portion and is diffusely reflected. Thereby, the exposure conditions for forming the columnar cured portion 105 can be stabled. Also, if the protrusion portion is removed, the rear face of the substrate 1 can be bonded to another plate accurately. Therefore, ink leakage or the like can be prevented.

EXAMPLE 2

The above-described methods for producing a nozzle plate were checked by the following method. A nozzle was formed in a substrate made of SUS430 having a thickness of 75 μm. Then, a photocuring resin film was pressure bonded to the surface of the substrate at a pressure of 0.2 MPa under the state where the film was heated to 80° C. In the pressure bonding of the photocuring resin film, a roller was moved at movement velocity 0.6 m/min once to apply the pressure of 0.2 MPa to the surface of the substrate. As the photocuring resin film, Ohdil FP215 produced by TOKYO OHKA KOGYO CO., LTD. was used. The thickness thereof was 15 μm. The photocuring resin film was substantially hardened by an exposure amount of 100 mJ/cm$^2$. When light was irradiated under this state and a suitable columnar cured portion was formed, that is, the columnar cured portion including the base portion having the outer diameter equal to the inner diameter of the ejection port of the nozzle and the head portion having the outer diameter smaller than that of the based portion by about 0.1 μm was formed, the exposure amount of the irradiated light was measured. When the suitable columnar cured portion is used, a water-repellent film can be formed along the ejection port of the nozzle, which is masked with the suitable columnar cured portion.

Substrates including ejection ports of nozzles having inner diameters 20 μm, 22 μm, and 25 μm, respectively were prepared as substrates to be measured. Furthermore, with regard to the substrates including the ejection ports of the nozzles having the inner diameter of 20 μm and 22 μm, the inventors prepared ones including taper portions having 8 degrees and 20 degrees, respectively for each inner diameter. With regard to the substrates including the ejection ports of the nozzles having the inner diameter of 25 μm, the inventors prepared ones including the taper portions having 8 degrees, 20 degrees, and 30 degrees, respectively. In addition, the inventors prepared one to which the polishing step was applied and ones to which the polishing step was not applied for each aforementioned substrate. Also, in all the substrates, straight lengths of straight portions of the nozzles were 0. Also, surface roughness of the polished surface 6 was Rz=0.18 μm. Incidentally, before the polishing step, the polished surface 6 had the surface roughness of Rz=0.35 μm. The surface roughness was measured with a stylus type surface roughness measurement apparatus SURFCOM 556A produced by TOKYO SEIMITSU CO., LTD. A measurement method conformed to JIS B 0660:1998 (JIS B 0601:1994) to measure a ten-point average roughness Rz. The inventors prepared three samples to be measured; measured one point for each sample; and adopted an average value of the measurement result.

The measurement result is shown in a table 2. Incidentally, in the table 2, a mark "x" indicates that a suitable columnar cured portion was not formed. In the columnar cured portion formed in this case, the photocuring resin was cured with outward expanding in the radial direction from the ejection port of the nozzle.

TABLE 2 unit: mJ/cm$^2$

| Taper angle | Polishing process | 8 degrees | 20 degrees | 30 degrees |
|---|---|---|---|---|
| Diameter of nozzle ϕ20 | Performed | 180 | x | x |
| | Not-performed | 100 | x | x |
| ϕ22 | Performed | 210 | x | x |
| | Not-performed | 140 | x | x |
| Φ25 | Performed | 240 | 180 | x |
| | Not-performed | 180 | 120 | x |

As shown in the table 2, under all conditions, since light having the exposure amount of 100 mJ/cm$^2$ was irradiated, the columnar cured portion was in a completely hardened state. It can be seen that as the inner diameter of the ejection port of the nozzle increases, the exposure amount required increases. The reason for this result is as follows. As the inner diameter of the ejection port of the nozzle increases, a ratio a region occupied by the taper portion to a region occupied by the ejection port of the nozzle in a light irradiation region increases. Therefore, influence of a light diffusely reflected by the taper portion on the formation of the columnar cured portion relatively decreases. At least in a range where the inner diameter of the ejection port of the nozzle is 15 μm to 30 μm, this tendency can be confirmed.

Also, in the substrate having the inner diameter of the ejection port of the nozzle of 20 μm or 22 μm, the suitable columnar cured portion could be formed when the taper angle of the taper portion was 8 degrees. However, when the taper angle of the taper portion was 20 degrees, the suitable columnar cured portion could not be formed. On the other hand, in the substrates having the inner diameter of the ejection port of the nozzle of 25 μm, the suitable columnar cured portion could be formed when the taper angle of the taper portion was 8 or 20 degrees. At this time, it can be seen that as the taper angle of the taper portion increases, the exposure amount decreases. Furthermore, in the substrates having the inner diameter of the ejection port of the nozzle of 25 μm, the suitable columnar cured portion could not be formed when the taper angle of the taper portion was 30 degrees. This is because as the taper angle of the taper portion increases, greater part of light diffusely reflected by the taper portion is irradiated to the photocuring resin. In other words, when greater part of the diffusely reflected light is irradiated to the photocuring resin, the photocuring resin is cured with outwardly expanding in the radial direction from the ejection port of the nozzle. Therefore, the suitable columnar cured portion cannot be formed. In order to form the suitable columnar cured portion, the taper angles of 5 degrees to 10 degrees are suitable. Incidentally, as the straight length of the straight portion of the nozzle is lengthen, it is more difficult for the diffusely reflected light to reach the photocuring resin disposed on the ejection port side of the nozzle. Therefore, the exposure amount required to form the suitable columnar cured portion increases. On the contrary, the taper angle, which increases the diffusely reflected light, can be widen in the range where the suitable columnar cured portion is formed. Therefore, freedom degree of the taper angle can be increased.

It can be seen that in the case of performing the polishing step to the substrate, the exposure amount required to form the suitable columnar cured portion increases in comparison with the case of not-performing the polishing step. The reason for this result is as follows. When the polishing step is performed, the protrusion portion formed in the periphery of the opening portion of the rear face of the substrate can be removed. Therefore, light diffusely reflected by the protrusion portion is not irradiated to the photocuring resin. Furthermore, the surface roughness of the entire rear face of the substrate is so smooth that Rz is changed from 0.35 μm to 0.18 μm. Therefore, it is difficult for light generated by reflection at the rear surface of the substrate to reach inside of the ink ejection port of the nozzle. This is also one of the reasons. Also, in a rage of FIG. 2, the inventors find the following relation in the case where the polishing step is performed.

$$y=12x-60$$

where x indicates the inner diameter of the ejection port of the nozzle; and y indicates the exposure amount. Also, the inventors find the following relation in the case where the polishing step was not performed.

$$y=16x-220$$

In other words, it can be seen that variation of the exposure amount, which is accompanied with variation of the inner diameter of the ejection port of the nozzle, is more moderate in the case where the polishing step is performed. Accordingly, the performing of the polishing step makes it easy to control the exposure amount, which is changed with the variation of the inner diameter of the ejection port of the nozzle.

The preferred embodiments of the invention have been described above, However, the invention is not limited to the aforementioned embodiments. For example, in the first embodiment, the columnar cured portion 5 of the semi-cured state is formed. However, the columnar cured portion may be in the completely hardened state so long as the columnar cured portion partially protrudes from the surface of the substrate 1 and has a diameter equal to the inner diameter of the ejection portion 2*c* of the nozzle 2.

Also, in the first and second embodiments, the nozzle 2 includes: the taper portion 2*a*, which is formed on the rear face side of the substrate and has a narrower shape as approaching to the surface side; and the straight portion 2*b*, which extends from the taper portion 2*a* to the surface of the substrate 1 in a penetrating manner. However the invention is not limited to the nozzle having such as shape. For example, the nozzle may include only a straight portion from the rear face of the substrate 1 to the surface in the penetrating manner or the nozzle may have another shape.

Also, in the second embodiment, the surface polishing process is applied to all over the rear face of the substrate 1 in the polishing step. However, the invention is not limited to this configuration. The surface polishing process may be applied to the periphery of the opening portion of the nozzle 2 on the rear face side of the substrate 1.

What is claimed is:

1. A method for producing a nozzle plate, comprising:

applying a photocuring resin onto a surface of a substrate that includes a nozzle while filling an ink ejection port of the nozzle with the photocuring resin;

irradiating light to the photocuring resin from a rear surface of the substrate through the nozzle to form a columnar cured portion, wherein the columnar cured portion includes:

a head portion that protrudes from the surface of the substrate and has an outer diameter smaller than an inner diameter of the ink ejection port; and a base portion that is disposed in the nozzle and has an outer diameter equal to the inner diameter of the ink ejection port;

removing the photocuring resin except for the columnar cured portion; and forming a water-repellent film on the surface of the substrate in a state where the columnar cured portion remains, wherein;

the columnar cured portion is in a semi-cured state that is an intermediate state of a photocuring reaction.

2. The method according to claim 1, wherein:

in the irradiating of the light, an exposure amount of the light irradiated to the photocuring resin is determined so that a cure ratio of the columnar cured portion is in a range of 50% to 80%, and the cure ratio is expressed as 100 −(a curing reaction heat of the columnar cured portion per unit weight)/(a curing reaction heat of an uncured photocuring resin per unit weight)×100.

3. The method according to claim 1, further comprising:

applying a surface polishing process to at least a periphery of an opening portion of the nozzle on the rear face of the substrate.

4. The method according to claim 1, wherein in the irradiating of the light, an exposure amount of the light is determined so that the head portion of the columnar cured portion protrudes from the surface of the substrate by 1 μm to 15 μm.

5. The method according to claim 1, wherein:

the nozzle includes:

a taper portion that has an inner diameter decreasing as approaching from the rear face of the substrate to the surface of the substrate; and a straight portion that has a cylindrical shape from a surface-side end of the taper portion to the surface of the substrate; and in the irradiating of the light, an exposure amount of the light is determined in accordance with at least one of the inner diameter of the ink ejection port at the surface of the substrate, an angle of inclination of the taper portion, and a length of the straight portion.

6. The method according to claim 5, wherein in the irradiating of the light, the exposure amount of the light irradiated to the photocuring resin increases as the inner diameter of the ink ejection port of the nozzle at the surface of the substrate increases in a rage of 15 μm to 30 μm.

7. The method according to claim 5, wherein in the irradiating of the light, the exposure amount of the light irradiated to the photocuring resin decreases as the angle of the inclination of the taper portion increases in a rage of 5 degrees to 10 degrees.

8. The method according to claim 1, wherein the applying of the photocuring resin includes pressure-bonding a photocuring resin film to the substrate while heating the substrate.

9. The method according to claim 8, wherein the heating in the applying of the photocuring resin heats the substrate at a temperature at which the photocuring resin is in a glass transition state.

10. The method according to claim 8, wherein the heating in the applying of the photocuring resin heats the substrate at 80° C. to 100° C.

11. The method according to claim 8, wherein the photocuring resin film has a thickness that is equal to or smaller than the inner diameter of the ink ejection port of the nozzle.

* * * * *